US007685779B1

(12) United States Patent
Nelson

(10) Patent No.: US 7,685,779 B1
(45) Date of Patent: Mar. 30, 2010

(54) MOLDED WALL FLASHING KICK OUT

(76) Inventor: Robert W. Nelson, 1824 Log Ridge Trail, Tallahassee, FL (US) 32312

( * ) Notice: Subject to any disclaimer, the term of this patent is extended or adjusted under 35 U.S.C. 154(b) by 1007 days.

(21) Appl. No.: 11/334,642

(22) Filed: Jan. 18, 2006

(51) Int. Cl.
*E04D 1/36* (2006.01)

(52) U.S. Cl. ..... 52/62; 52/58; 52/97

(58) Field of Classification Search ..... 52/58, 52/97, 60

See application file for complete search history.

(56) References Cited

U.S. PATENT DOCUMENTS 3,533,201 A * 10/1970 Tyler ..... 52/60
5,109,641 A 5/1992 Halan
5,333,419 A 8/1994 Hickner
5,675,939 A 10/1997 Hickner
6,401,402 B1 6/2002 Williams
6,481,164 B1 * 11/2002 McCorkel ..... 52/58
6,681,530 B1 1/2004 Givens
6,725,617 B2 4/2004 Cox
7,219,477 B2 * 5/2007 Leffler ..... 52/716.1
2004/0226225 A1 11/2004 Olk et al.

* cited by examiner

*Primary Examiner*—Jeanette E Chapman
*Assistant Examiner*—Daniel Kenny
(74) *Attorney, Agent, or Firm*—Peter Loffler

(57) ABSTRACT

A molded wall flashing kick out is designed to be the lower terminus end of a flashing system that is used wherein a roof section terminates against a sidewall of a building. The molded wall flashing kick out has a sheet-like body member that is bent along a longitudinal seam. A kick out plate is integrally formed on the end cap and extends outwardly from a generally vertical section of the body member toward and attaches to a generally horizontal section of the body member. A channel, which may have two sections, is formed on the body member in order to receive a vinyl siding J-channel. The outer edge of the horizontal section of the body member is curled while at least one opening is located on the vertical section of the body member in order to receive a fastener therethrough.

12 Claims, 2 Drawing Sheets

MOLDED WALL FLASHING KICK OUT

BACKGROUND OF THE INVENTION

1. Field of the Invention

The present invention relates to a molded wall flashing kick out that is installed on a roof side wall interface of a building such that the flashing end cap has an integral kick out plate to divert water away from the building as well as a J-channel receiver for receiving a J-channel used for vinyl siding.

2. Background of the Prior Art

Many buildings have multiple roof levels wherein the end of one of the roof decks terminates and abuts against a side wall of the building. In building the roofing system for such a configuration, a section of flashing is run along the entire length of the roof deck side wall interface. The purpose of the flashing, which is an angled sheet member of monolithic construction, is to help seal the juncture of the roofing deck with that of the side wall in order to prevent water from entering the building at this juncture. Flashing, which is also used in other areas of roof construction, works with a high degree of reliability. However, one problem with such flashing installation occurs at the lower terminus of the flashing whereat the roof deck ends. Hereat, water oftentimes tends to wick around the end of the generally vertical leg of the flashing and behind the flashing wherein the water may penetrate into the interior of the building. To combat this problem, a kick out plate is constructed at the lower end of the flashing by taking a small length of the end of the vertical leg of the flashing, placing a small cut into the flashing between the horizontal leg and the vertical leg, and bending the vertical section inwardly over or toward the horizontal leg so that as water flows down the flashing, the kick out plate at the end kicks the water away from the building in order to minimize water intrusion into the building at this area of the roof. The problem with this type of kick out plate is that oftentimes workers will completely forget to construct one, leaving the roof vulnerable to water penetration. Additionally, if the cut or bend is not properly performed by the worker, then the kick out plate may achieve lower effectiveness. Furthermore, some flashing systems are now being made from plastic material which material is difficult if not impossible to bend inwardly to form the kick out plate.

Accordingly, there exists a need in the art for a system that allows a flashing system to have a kick out plate without the need for a worker to form the plate in order to reduce the possibility of oversight or incorrect kick out plate manufacture. Such a system must be usable in a roof deck to side wall transition area and must be usable with flashing systems made from a variety of materials. Ideally, such a system must allow vinyl siding systems to have a neater appearance when used with the system. Advantageously, such a system will be of relatively simple design and construction and be easy to use and install.

SUMMARY OF THE INVENTION

The molded wall flashing kick out of the present invention addresses the aforementioned needs in the art by providing an end cap for use with roof flashing wherein the end cap has a kick out plate for diverting water from the building. The molded wall flashing kick out does not require that a worker form the kick out plate thereby reducing the possibility of kick out plate formation oversight or incorrect construction. The molded wall flashing kick out is usable in a roof deck to side wall transition area and is usable with flashing systems made from a variety of materials. The molded wall flashing kick out, when installed on a building utilizing vinyl siding on the side wall whereat the molded wall flashing kick out is installed has a subsystem that gives the installed vinyl siding a neater overall appearance. The molded wall flashing kick out is of relatively simple design and construction and is easy to use and install.

The molded wall flashing kick out of the present invention is comprised of a body member that is a sheet member that has a first end, a second end, a first side edge, and a second side edge. A seam extends along the body member between the first end and the second end such that the body member is bent along the seam in order to form a first section proximate the first side edge and a second section proximate the second side edge that are angularly offset from one another. A kick out plate extends from the second section toward the first section and is attached to the first section. The first side edge of the body member is curled. At least one opening is located on the second section of the body member proximate the second side edge. A first channel member extends outwardly from the second section and runs above and parallel with a portion of the first section while a second channel extends outwardly from the second section and runs along at least a portion of the kick out plate such that the first channel and the second channel form a single continuous overall channel. The body member, the kick out plate, the first channel, and the second channel may all be of monolithic construction.

BRIEF DESCRIPTION OF THE DRAWINGS

Similar reference numerals refer to similar parts throughout the several views of the drawings.

DESCRIPTION OF THE PREFERRED EMBODIMENT

Figure 1:
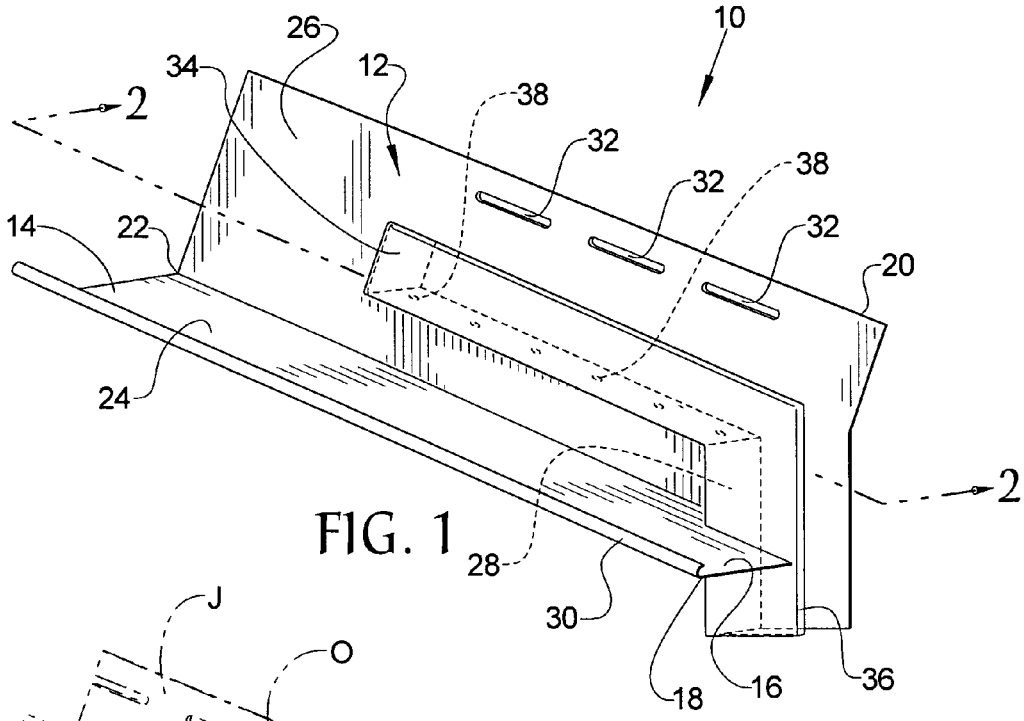
FIG. 1 is a perspective view of the molded wall flashing kick out of the present invention.
Figure 2:
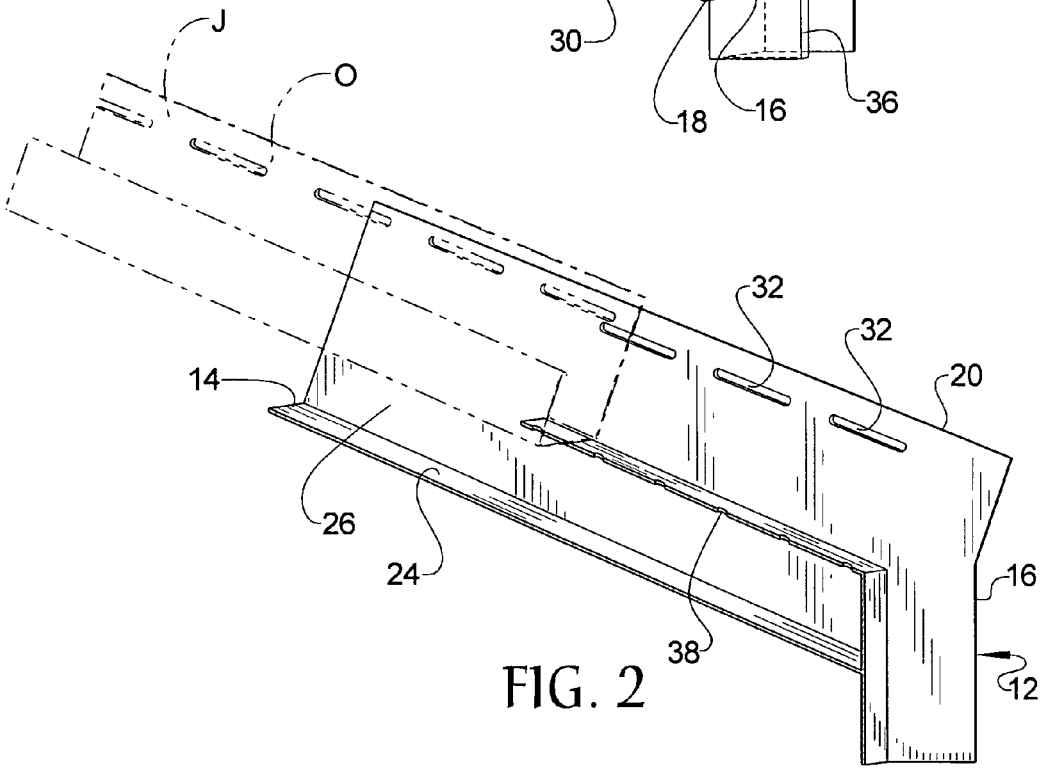
FIG. 2 is a sectioned perspective view of the molded wall flashing kick out taken along line 2-2 in FIG. 1.
Figure 3:
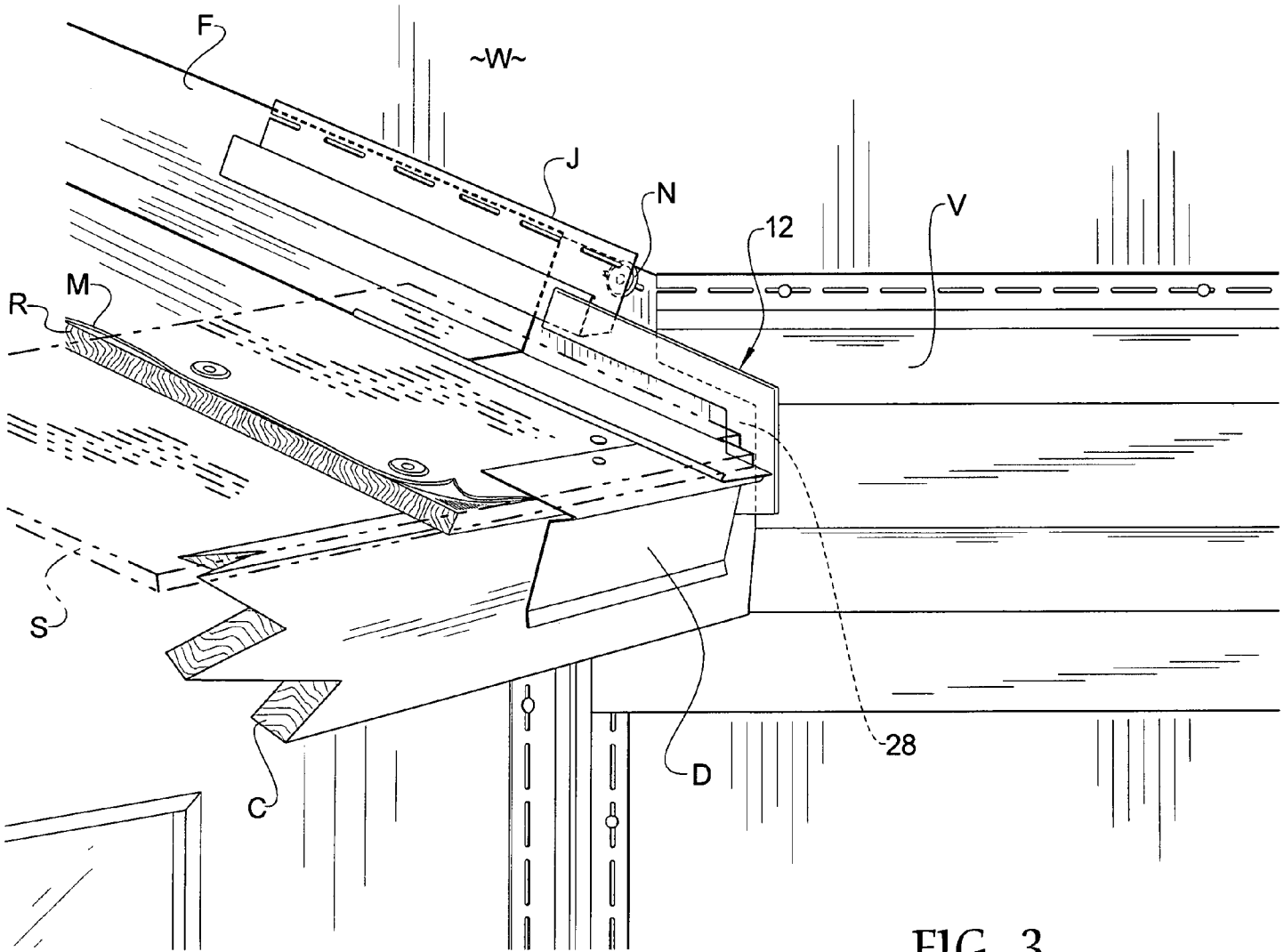
FIG. 3 is a perspective view of the molded wall flashing kick out installed within a roofing system.

Referring now to the drawings, it is seen that molded wall flashing kick out of the present invention, generally denoted by reference numeral 10, is comprised of a body member 12 that is a sheet member that has a first end 14, a second end 16, a first side edge 18, and a second side edge 20. A seam 22 extends along the body member 12 between the first end 14 and the second end 16 such that the body member 12 is bent along the seam 22 in order to form a first section 24 having the first side edge 18 and a second section 26 having the second side edge 20. The first section 24 and the second section 26 are angularly offset from one another, the specific angle being the angle between the two sections of a section of flashing F that is used with the flashing end cap 10 of the present invention. A kick out plate 28 extends from the second section 26 of the body member 12 toward the first section 24. The kick out plate 28 is attached to the first section 24. The first side edge 18 of the body member 12 has a curled portion 30. At least one opening 32 is located on the second section 26 of the body member 12 proximate the second side edge 20. A first channel member 34 extends outwardly from the second section 26 and runs above and parallel with a portion of the first section 24 of the body member 12 while a second channel 36 extends outwardly from the second section 26 and runs along at least a portion of the kick out plate 28 such that the first channel 34 and the second channel 36 form a single continuous overall channel. One or more openings 38 may be located within the first channel 34.

The body member 12, the kick out plate 28, the curled portion 30, the first channel 34, and the second channel 36 may all be of monolithic construction and may be constructed from appropriate flashing material such as metal, including aluminum, or plastic, including vinyl. By using monolithic construction, there are no connection seams between the various components minimizing the risk of water penetrating through the flashing end cap 10. However, if monolithic construction is not utilized, appropriate seals are placed at any connection seams formed.

In order to use the molded wall flashing kick out 10 of the present invention, the flashing end cap 10 is placed on a roof system wherein the roof deck R connects into a side wall W of building. Specifically, the flashing end cap 10 is placed at the lower end section of the roof deck R where the roof deck R connects to the side wall W. The flashing end cap 10 is positioned over any roof felt M, drip edge D, and shingle S, that are used as part of the roof system. The body member 12 overhangs the fascia board C. The body member 12 is attached to the roof deck R in the usual way such as by using roofing cement. The flashing F is positioned so that it overlies the upper portion of the body member 12 and sits within the body member 12. The lower outer edge of the flashing F is received within the curled portion 30 of the flashing end cap 10 for better securement thereat. The flashing F is attached to the flashing end cap 10 in any appropriate fashion. A vinyl siding J-channel J is received within the first channel 34 and, depending on the specific architecture of the building, a second vinyl siding J-channel J is received within the second channel 36. The first J-channel J is attached to the building by passing an appropriate fastener N through an opening O on the J-channel J, which opening O is aligned with one of the openings 32 of the body member 12. Several such fasteners N may be used as needed. In use, water flows down the flashing F in the normal way. If desired, additional fasteners N can be passed through the J-channel J and through the openings 38 located within the first channel 34. At the end of the flashing F, the water transitions onto the body member 12 and when the water encounters the kick out plate 28, the water is diverted (kicked out) away from the building and thereafter falls to the ground. The curled portion 30 of the body member 12 not only helps receive and guide the flashing F onto the body member 12 but also helps prevent the water from flowing underneath the body member 12 whereat the water has the possibility of penetrating into the building. The first channel 34 and possibly the second channel 36 help with the installation of a standard vinyl siding J-channel J onto the building in order to give the vinyl siding V installed an overall neat appearance at its end that is proximate the roof deck R.

While the invention has been particularly shown and described with reference to an embodiment thereof, it will be appreciated by those skilled in the art that various changes in form and detail may be made without departing from the spirit and scope of the invention.

I claim:

1. An end cap comprising:

a body member which is a sheet member having a first end, a second end, a first side edge, a second side edge, a seam extending between the first end and the second end such that the body member is bent along seam in order to form a first section proximate the first side edge and a second section proximate the second side edge the first section and the second section connected directly to one another at the seam, and the first section having an upper surface and a lower surface;

a kick out plate having a first leg attached to the second section and oriented parallel with the second leg extending from the first leg and oriented at an obtuse angle with the first leg, the second leg attached to the first section at an obtuse angle and extending above the upper surface of the first section and below the lower surface of the first section; and a plate attached to the kick out plate so as to form a first channel member extending outwardly from the second section and running above and parallel with a portion of the first section and a second channel extending outwardly from the second section such that the first channel and the second channel form a single continuous overall channel.

2. The end cap as in claim 1 wherein the body member and the kick out plate are of monolithic construction.

3. The end cap as in claim 1 wherein the first side edge is curled.

4. The end cap as in claim 1 further comprising at least one opening located on the second section proximate the second side edge.

5. The end cap as in claim 1 wherein the body member, the kick out plate, and the first channel are all of monolithic construction.

6. The end cap as in claim 5 further comprising at least one opening located on the second section proximate the second side edge.

7. The end cap as in claim 6 wherein the first side edge is curled.

8. The end cap as in claim 5 wherein the first side edge is curled.

9. The end cap as in claim 1 wherein the body member, the kick out plate, the first channel, and the second channel are all of monolithic construction.

10. The end cap as in claim 9 wherein the first side edge is curled.

11. The end cap as in claim 10 further comprising at least one opening located on the second section proximate the second side edge.

12. The end cap as in claim 9 further comprising at least one opening located on the second section proximate the second side edge.

* * * * *